US005240123A

United States Patent [19]

Hawk

[11] Patent Number: 5,240,123

[45] Date of Patent: Aug. 31, 1993

[54] BASEBALL CAP HOLDER

[76] Inventor: Gary D. Hawk, 1415 N. Kentucky St., Iola, Kans. 66749

[21] Appl. No.: 901,416

[22] Filed: Jun. 19, 1992

[51] Int. Cl.[5] ..... A47F 7/00

[52] U.S. Cl. ..... 211/32; 211/30; 248/309.1

[58] Field of Search ..... 211/32, 30, 87, 113, 211/33, 118; 248/309.1

[56] References Cited

U.S. PATENT DOCUMENTS

| | | | |
|---|---|---|---|
| 2,461,178 | 2/1949 | Reinke | 211/32 |
| 2,535,136 | 12/1950 | Jacobson | 211/32 |
| 3,212,647 | 10/1965 | Meyer et al. | 211/118 |
| 4,063,669 | 12/1977 | Smilow et al. | 223/87 |
| 4,573,590 | 3/1986 | Ellis | 211/118 X |
| 4,583,646 | 4/1986 | Bowman | 211/32 |
| 4,673,153 | 6/1987 | Hilty et al. | 248/231.8 |
| 4,805,782 | 2/1989 | Hale et al. | 211/30 |
| 5,002,190 | 3/1991 | Moreland | 211/32 |
| 5,096,070 | 3/1992 | Jaynes | 211/113 X |
| 5,121,842 | 6/1992 | Osborne | 211/30 X |

*Primary Examiner*—Robert W. Gibson, Jr.

*Attorney, Agent, or Firm*—Kenneth W. Iles

[57] ABSTRACT

Three preferred embodiments of a baseball cap holder are disclosed. Each embodiment includes a chamfered button ring for retaining a cap by the button typically found at the top of the crown of the cap. All three embodiments in a preferred method of manufacturing are die cut and crease scored from a single sheet of material, such as polypropene plastic. The first embodiment mounts and displays a single baseball cap and comprises a vertical base mounted on a wall, a horizontal cap shape holder and a parallel and spaced chamfered button ring for slidably receiving the cap button. The second embodiment is a cap holder strip, which utilizes a plurality of similar button rings aligned along an elongated axis. The third embodiment comprises a circular pattern having a base for vertical mounting on a wall or the like, a horizontal cap supporting member and above and parallel to the cap supporting member, a button ring. The cap supporting member and the button member are forced toward each other by the memory of the plastic, thereby gripping the cap. The base displays an imprint area for advertising even while in use.

28 Claims, 4 Drawing Sheets

BASEBALL CAP HOLDER

BACKGROUND OF THE INVENTION

1. Field of the Invention

The present invention is related to an apparatus for storing and displaying baseball caps, visors and the like, having a bill. More particularly, the present invention is directed to a means for holding baseball caps by the button on the top of the cap and displaying caps either singly or along a strip of cap holders in a vertical or horizontal orientation.

2. Description of Related Art Includinq Information Disclosed Under 37 C.F.R. Sections 1.97-1.99

Many people collect baseball caps, tennis visors and the like (hereinafter "baseball caps") and care for their collection diligently. Many companies give baseball caps to customers to advertise and promote their products, making it relatively easy to collect large numbers of baseball caps. The owners of these collections like to display their caps and show them off to their friends. Many of these collections number in the hundreds or thousands of caps. Storing or displaying sizable collections presents a problem to even the most fastidious baseball cap collector.

Efforts to overcome this problem has lead to a number of issued United States patents and other devices.

For example, U.S. Pat. No. 5,002,190, issued to Moreland on Mar. 26, 1991, discloses a "Sports Cap Rack" consisting of a longitudinal member designed to be mounted vertically on a wall and having a plurality of spaced apertures. The second and separate element has an arcuate arm designed to fit the front of a cap. The arcuate arm is attached to a straight member that is inserted into an aperture in the vertical member. The device looks like a series of deer antlers mounted on a vertical pole. The antler portion fits inside the cap, holding it like an abbreviated shelf. This display rack requires assembly, either by the manufacturer or the ultimate user.

U.S. Pat. No. 4,673,153 issued to Hilty et al. on Jun. 16, 1987, discloses a "Clothing Suspension Apparatus" for holding and displaying a plurality of baseball caps in a vertical orientation. The holder includes a vertical cylindrical stalk having a number of cap button holders formed about a circular collar that slides along the stalk. The button holder comprises a button engagement member which includes a slot that is wider at its front or open end than at its closed or back end. The button on the top of the crown slides rearward into the slot, which is horizontally orientated. This device requires the manufacture and assembly of separate parts and presents an untidy appearance when not filled with caps. Caps so displayed are pulled toward the front, or open end, of the slot by the force of gravity. To prevent the caps from falling out of the slot requires considerable frictional engagement between the button and the slot, causing undue wear on the button, which holds the different pieces of the crown together. In addition, this device is unsuitable for mounting caps that do not have a button at the top of the crown.

U.S. Pat. No. 4,063,669, issued to Simlow et al. on Dec. 20, 1977, discloses a "Display Belt Hanger" of the type commonly used in retail stores to hand and display men's belts and includes a hole for inserting the tongue of a belt buckle for displaying a belt vertically.

U.S. Pat. No. 2,535,136, issued to Jacobson on Dec. 26, 1950, discloses a "Collapsible Hat Holder" designed to hold hats with full brims all the way around the crown of the hat, such as cowboy hats, by holding the brim. The holder is mounted vertically on a wall and displays a number of hats along a vertical axis. A hinged rod pivots downward by gravitational force at each hat-holding location and tends to hold a hat in place when a hat is placed under the pivoting rod. Two parallel sets of rods are used so that one rod presses against the hat brim along both sides of the crown. This hat holder is obviously unsuitable for holding or displaying baseball caps because they do not have a brim on each side of the crown.

U.S. Pat. No. 2,461,178, issued to Reinke on Feb. 8, 1949, discloses a "Hat and Tie Holder" that is basically a wire clothes hanger bent into a shape that allows it to receive two hats in detents in the upper portion of the holder and to receive neckties along a horizontal member below the hats. The hats are held by the spring tension of the hanger when the circumference of the crown is pressed into the similarly shaped detent. This hat holder is obviously not suitable for displaying a large number of hats, and is not suitable for displaying baseball caps at all because a baseball cap does not have a shaped and resilient crown.

Also available in the related art is a device called "Cap Capers—The Ultimate Display for Baseball Caps." An actual commercially available model includes the word "patented," but no patent number. A search of the related art failed to locate a corresponding patent. The device consists of an inverted T-shaped rigid plastic frame having an outward projecting horizontal member at the top. The outward projecting member includes a slot for accepting the button on the top of the cap. At each end of the arms of the inverted T-shape is a vertical slot for inserting a portion of the crown of the cap. The device includes an aperture for securing it to a wall and also includes one part of a two-part hook and loop fastener set, thereby providing an alternative means for fastening the device to a wall. This device is capable of holing only a single cap. The use of the two vertical slots for retaining the lower portion of the crown prevents the cap from falling out of the slot and greatly reduces the frictional engagement required between the button of the cap and the slot, thus overcoming some of the difficulty with Hilty et al. '153, infra. It is awkward and time consuming to use, however, because it is difficult to insert the lower portion of the crown into the two slots and it is difficult to align the cap in the slots so that the cap presents a symmetrical appearance when mounted.

As the foregoing discussion makes clear, the related art fails to provide a means for displaying baseball caps that is aesthetically pleasing or uses space efficiently, and that is inexpensive to manufacture, ship, store and that requires no assembly.

SUMMARY OF THE INVENTION

Accordingly, it is a primary object of the present invention to provide a cap holder that is easy to use.

A further object of the present invention is to provide a cap holder that provides an aesthetically pleasing means for displaying one or more baseball-type caps.

A further object of the present invention is to provide a cap holder that uses space efficiently, both in displays, and in shipping the cap holders to customers.

A further object of the present invention is to provide a cap holder that is inexpensive to manufacture, store and ship.

A further object of the present invention is to provide a cap holder that requires no assembly by the end user and thus is convenient to mount and use.

A further object of the present invention is to provide a cap holder that attractively displays many caps in a simple high density display.

A further object of the present invention is to provide a cap holder that can conveniently display many caps in a portable or temporary display.

One preferred embodiment of the cap holder is designed to hold one cap mounted on a vertical display space, such as a wall, and to retain the natural shape of the crown. As many of these single cap holders as desired may be mounted in a particular display area in any desired pattern. This single cap holder is cut from a sheet of suitable material, which is bent in a certain fashion along the score lines to prepare the cap holder for mounting and use. The cap holder is made from a single piece of material, except for mounting hardware and is die cut and scored from a sheet of material such as polypropene sheet according to a certain pattern. This type of cap holder is exceedingly efficient to ship and store, as it is shipped flat. Alternatively, the single cap holder embodiment may be injection molded plastic or the like and will be ready for mounting and use without any bending.

An alternative preferred embodiment is a cap strap, which provides high density display space on a wall or other vertical surface. The cap strap model is shaped like a strap, is made of polypropene sheet for toughness and durability, and holds any reasonably desirable number of caps along a vertical or horizontal axis.

Like the single cap holder, the cap strap includes a button ring to hold the cap by the button found at the top of the crown of most baseball type caps. A plurality of die cut tongues, each carrying a button ring, allows the button ring to be lifted away from the body of the cap strap. The cap is folded as described above and the top button of the cap is inserted into the button ring from the underside of the button ring and is pulled outwardly so that the cap button contacts the front edge of the button ring. Then the cap is released. The cap falls downward in front somewhat, that is, with the bill below the horizontal, fully displaying any design, logo, motto, and so forth that may be found on the front portion of the cap's crown. Appropriate spacing of the serial cap buttons allows each cap to be fully displayed.

The cap holder strap further includes a lock element in the top portion of the cap strap and a mating key element in the lowest tongue that allow any number of cap holder straps to be linked together into a single strip. The lock portion comprises an aperture cut out in substantially the shape of a convention coat hanger and the key portion comprises a pair of projecting shoulders with a recessed slot in the lowest tongue on the cap holder strap. The shoulders are adjacent to the body of the cap holder strap. The lowest tongue is bent outward at about 90 degrees from the body of the cap strap and the lock of one strap is snapped on over the shoulders of the key, thereby linking two cap straps and doubling the capacity of the system, while still allowing full use of the tongue used for linking the two straps and maintaining a uniform distance between all caps, even when two cap straps are linked together.

Other objects and advantages of the present invention will become apparent from the following description taken in connection with the accompanying drawings, wherein is set forth by way of illustration and example, the preferred embodiment of the present invention and the best mode currently known to the inventor for carrying out his invention.

DETAILED DESCRIPTION OF THE PREFERRED EMBODIMENTS

As required by the Patent Statutes and the case law, the preferred embodiment of the present invention and the best mode currently known to the inventor for carrying out the invention are disclosed in detail herein. The embodiments disclosed herein, however, are merely illustrative of the invention, which may be embodied in various forms. Therefore, specific structural and functional details disclosed herein are not to be interpreted as limiting, but merely to provide the proper basis for the claims and as a representative basis for teaching one skilled in the art to which the invention pertains to make and use the apparatus disclosed herein as embodied in any appropriately specific and detailed structure.

Figure 1:
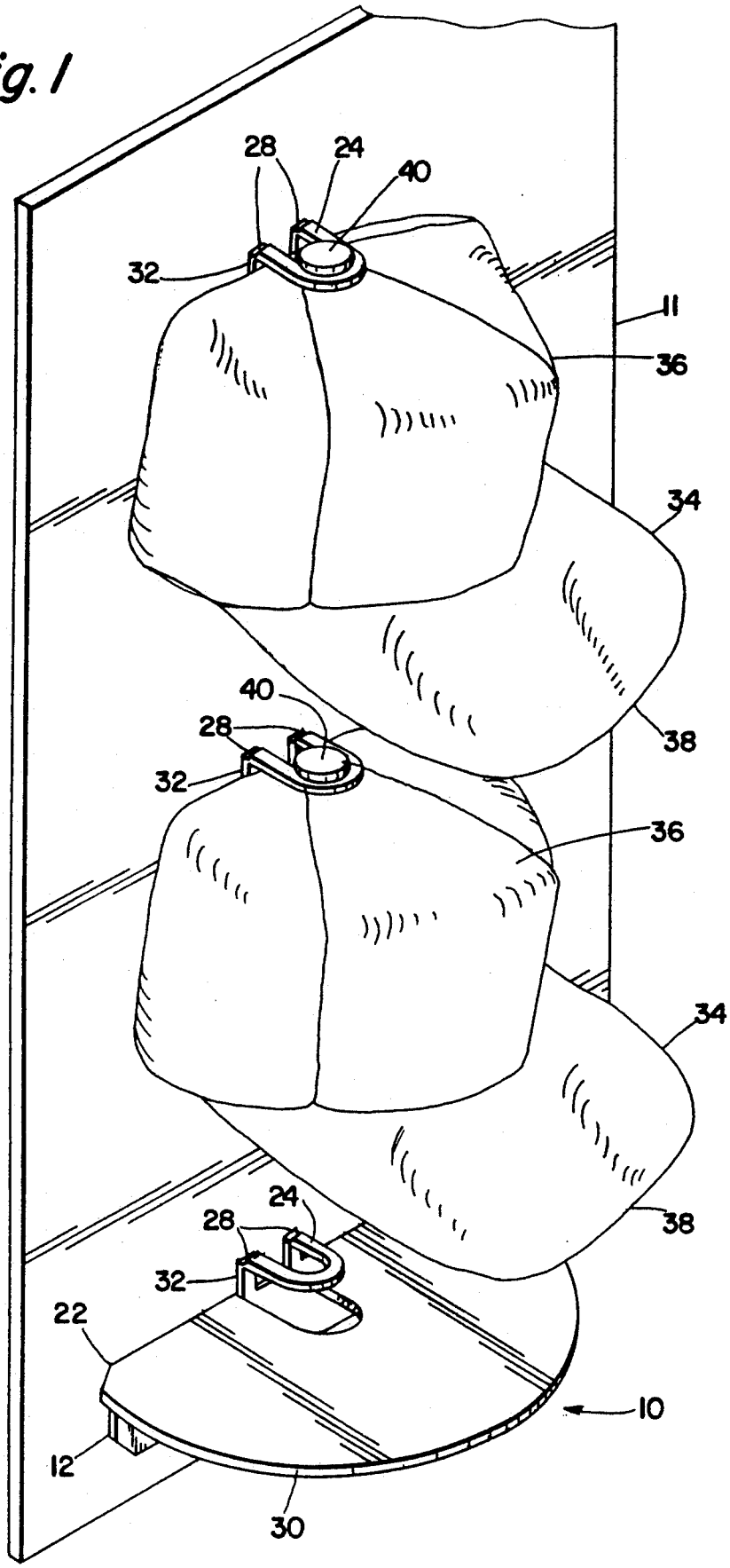
FIG. 1 is a perspective environmental view of a preferred embodiment of the cap holder in use shown mounted on a wall.

Referring to FIG. 1, there is shown a preferred embodiment of the cap holder according to the present invention, namely a full bill single cap holder 10 mounted on a wall 11 or the like and two additional cap holders 10 shown with a cap 34 mounted on each. Any desired number of the full sized single cap holders 10 may be thus mounted on a wall 11 or the like in any desired display pattern, such as vertical and horizontal rows, irregular patterns and so forth.

Figure 2:
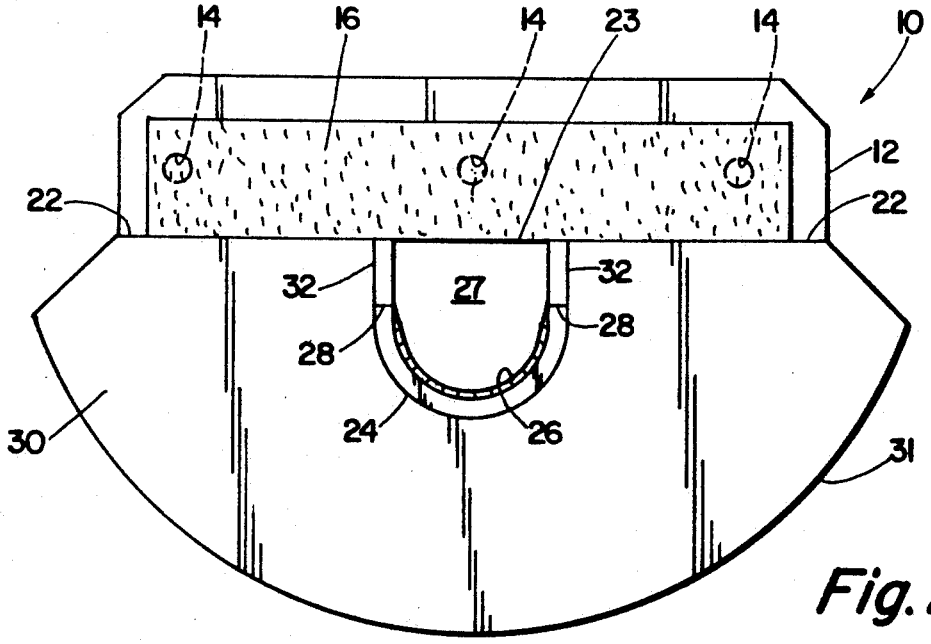
FIG. 2 is top plan view of the cap holder of FIG. 1 shown flat, that is, prior to bending various parts in preparation for mounting and use.

Referring now to FIG. 2, there is shown the full sized single cap holder 10 in top plan view prior to bending for use. The cap holder 10 is formed from a single piece of material, except for mounting hardware, by die cutting, injection molding, or the like, in flat form that is appropriately shaped for use by bending it in certain places to prepare the cap holder 10 for mounting and use. In a preferred embodiment, those certain bends are made along crease scores in the material, which allows the bends to be made easily and, if desired, repeatedly. The cap holder 10 comprises a crown shape holder 30 having a substantially semicircular or arcuate leading edge shaped to fill the lower crown 36 portion of the baseball cap 34 adjacent to the bill 38, thereby providing a full shape for the front portion of the cap 34, as illustrated in FIG. 1. The cap holder 10 further includes a base 12 formed by a straight line crease score 22 on the upper surface of the cap holder 12 as illustrated in FIG. 2, which allows the base 12 to be bent downward at 90 degrees, as shown in FIGS. 1, 2, and 3.

Still referring to FIG. 2, the cap holder 10 includes a button ring 24, having a chamfered leading edge 26, which is an arcuate portion of a circle, for slidably receiving the button 40 at the top of a cap 34 readily but with a firm degree of frictional engagement to retain the cap 34. In each of the embodiments described in this specification, the chamfered edge of a button ring is feathered into the edge of the material where the button ring meets the button access aperture, which facilitates mounting the cap onto the button ring by sliding the button of the cap onto the button ring.

An aligned pair of cease scores 28 on the upper surface of the cap holder 10 as shown in FIG. 2 define the end of the button ring 24 and the beginning of a button ring standoff 32, which terminates at the crease score 22. The area 27 enclosed by the button ring 24, the button ring standoff portion of the crease score 23 and the base 12 is cut out from the pattern and discarded, with a cut line 23 shown between the legs of the button ring standoff 32. It is important to note that the crease score 22 does not extend through any portion of the button ring standoff 32, which leaves the button ring standoff 32 and the button ring 24 as extensions, actually, of the base 12. This is important for preparing the cap holder 10 for mounting and use and is a critical feature of the invention.

Figure 3:
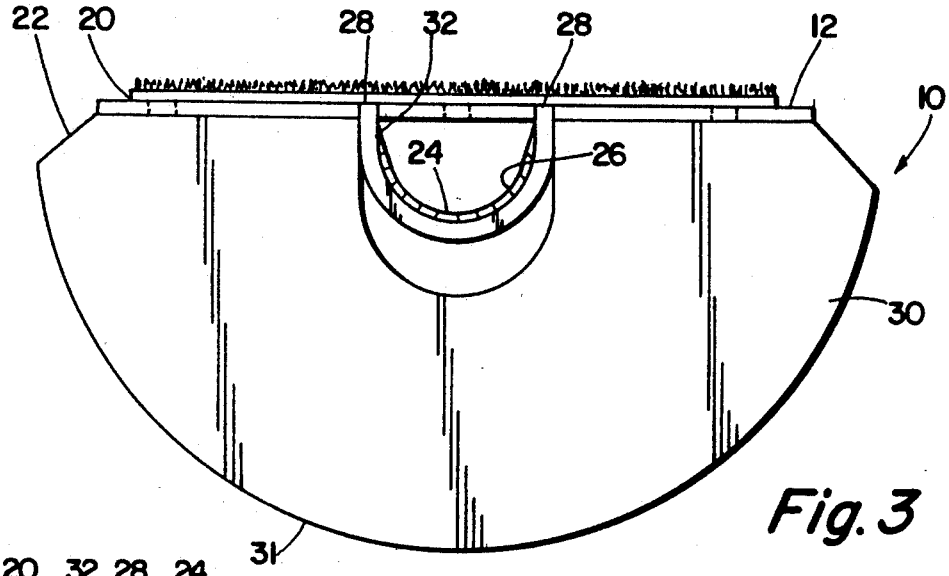
FIG. 3 is a top plan view of the cap holder of FIG. 1 bent into the use position.

Referring now to FIGS. 2 and 3, the shape of the cap holder 10 ready for use is illustrated. To prepare the cap holder for use, certain bends are made along the crease scores described above. In this written description of these bends, all described angles and directions are in terms relative to the orientation of the flat cap holder 10 as shown in FIG. 2. The base 12 is bent down at 90 degrees from the crown shape holder 30 along the crease score 22. This manipulation automatically forces the button ring standoff 32 and button ring 24 up 90 degrees relative to the crown shape holder 30 because they are really an extension of the base, since the crease score 22 does not span the die cut line 23. This step leaves the button ring standoff 32 and button ring 24 vertical. Then the button ring 24 is bent down 90 degrees from the button ring standoff 32, which is now upright, so that the button ring 24 is parallel to the crown shape holder 30 and spaced above it. The cap holder 10 is now ready for mounting and use. Mounting is discussed below.

Figure 6:
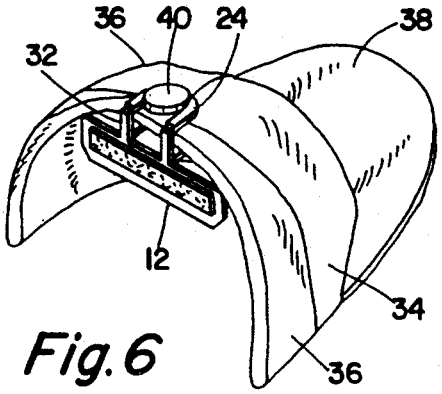
FIG. 6 is a perspective view of the cap holder of FIG. 1 as shown in FIG. 5 and having a baseball cap mounted on it.

In use, the user folds the back half of the crown of the cap 34 into the front half of the crown and then slips the button 40 under the button ring 24 of the cap holder 10 and pulls the cap 34 forward so that the button 40 slides into the button ring 24. The chamfer 26 facilitates engaging the cap button 40 into the button ring 24, with the cap 34 held most securely when the button 40 is pulled to the front of the button ring 24, as illustrated in FIGS. 1 and 6.

Figure 4:
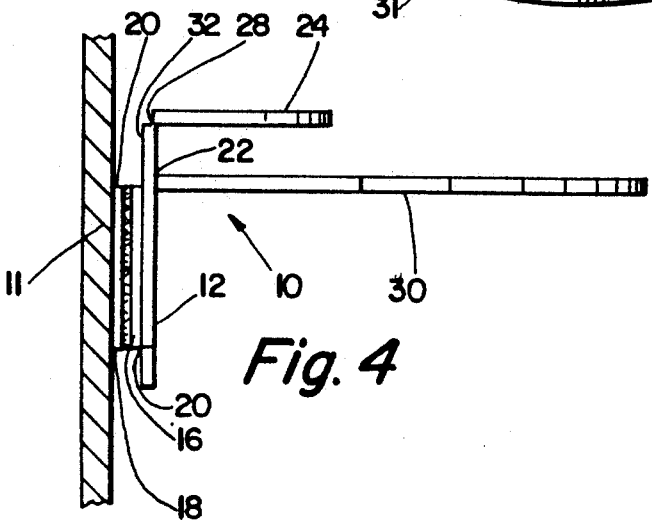
FIG. 4 is a side elevation of the cap holder of FIG. 1 mounted on a wall.
Figure 5:
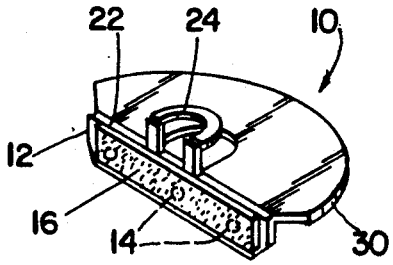
FIG. 5 is a perspective view from the back and side of the cap holder of FIG. 1 shown ready for mounting and use.

Still referring to FIG. 2, mounting the cap holder 10 on a wall 11 or the like may be accomplished by a variety of methods. One portion of a hook and loop fastener set, such as the hook portion 16 shown in FIG. 2 is attached to the base 12 by a suitable adhesive and the mating portion 17 of the hook and loop fastener set is similarly attached to the wall 11 (See FIG. 4) and the base 12 of the cap holder 10 is simply pushed against the mating hook and fastener set. Alternatively, the base 12 is also provided with a plurality of die cut knockouts 14, which the user can easily punch out and use for mounting apertures through which to insert mechanical fasteners, such as screws. Referring to FIG. 4, the cap holder 10 is shown in side elevation mounted on a wall 11. An adhesive layer 20 fastens the loop portion 18 to the wall 11 and a similar adhesive layer 20 fastens the hook portion 16 to the base 12 of the cap holder 10 and the hook portion 16 and loop portion 18 of the hook and loop fastener are pushed together to retain the cap holder on the wall 11.

Figure 7:
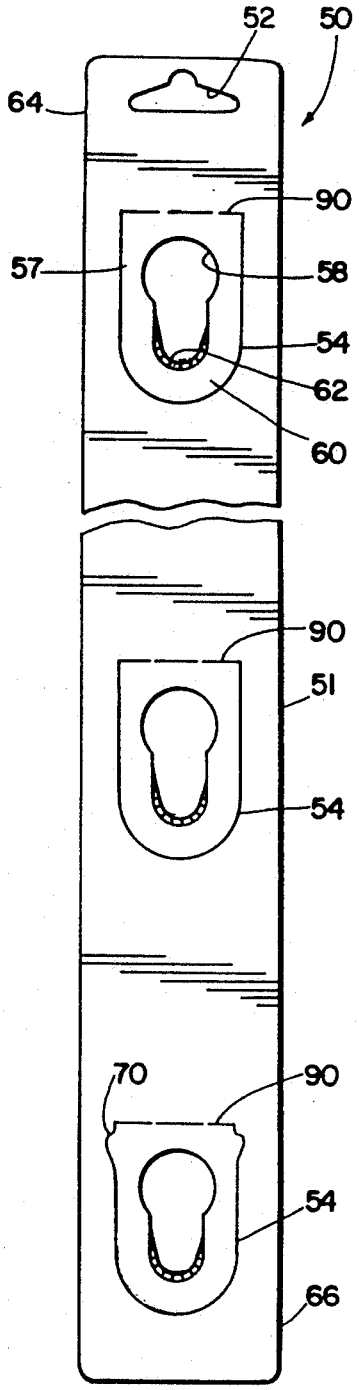
FIG. 7 is a front elevation of another preferred embodiment of the cap holder, designated a "cap holder strap" because it allows a plurality of baseball caps to be mounted on a single longitudinal strap.
Figure 8:
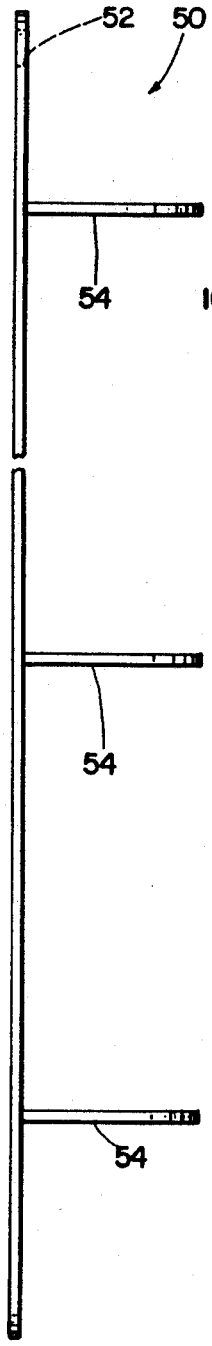
FIG. 8 is a side elevation of the cap holder strap of FIG. 7, showing the tongues on which the caps will be mounted bent into the use position, that is, at about 90 degrees to the body of the cap holder strap.
Figure 9:
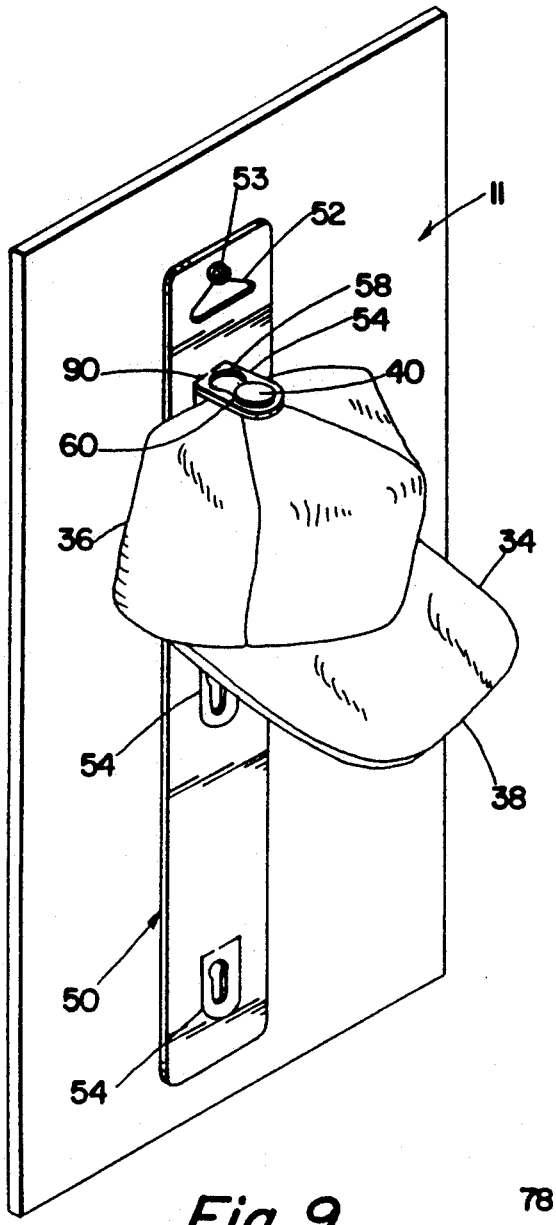
FIG. 9 is a perspective environmental view showing the cap strap of FIG. 7 in use.

Referring now to FIG. 7, there is shown an alternative embodiment of the cap holder, referred to as the "cap holder strap" 50, which comprises a plurality of tongues 54 whose shape is die cut into a single sheet of suitable material along the line 57 and can be bent outward from a body of the cap strap 50 at about 90 degrees, as shown in FIG. 8, to provide convenient access for hanging caps 34 by their crown buttons 40. FIG. 9 illustrates the cap holder strap 50 in use in a perspective environmental view. When initially used, the caps 34 will be suspended substantially horizontally with the tongues 54 being horizontally disposed by bending along the crease score 90. Over time, however, the weight of the caps 54 may cause the tongues 54 to droop down from the horizontal, and, therefore, so will the caps 34. The dimensions of the cap holder strap 50, however, are such that, when the caps 34 droop, they are still separated one from the other and the front of the crown 36 is fully displayed, allowing the owner or viewer to see and identify any particular cap and to read any logo, advertising, or the like that is imprinted on the crown 36 of the cap 34.

Die cut into each tongue is a button ring 60 having a chamfer 62 for easy and positive insertion of the button 40 of a cap 34. Adjacent to the button ring 60 is a button access aperture 58 having a larger diameter than the button ring 60 for allowing the button 40 to be easily inserted into the opening and then pulled forward, as shown in FIG. 7, to lock the button 40 into the button ring 60. The cap holder strap 50 may be made in any desired length and with any number of tongues. A preferred number is six tongues 54 on one cap holder strap 50, with, of course, one cap 34 being mounted on each tongue 54. When a cap 34 is mounted on a tongue 54, the weight of the cap tends to pull the tongue 54 downward somewhat from the horizontal position shown in FIG. 8. The vertical spacing between the button rings 60 is such that the crown of each cap is fully visible and displayed, an important feature for many cap collectors, who want the logos, words, pictures and the like that are typically placed in this area of the cap, to be fully displayed.

Still referring to the cap holder strap embodiment, in some cases it may be desirable to suspend the cap holder strap horizontally. The cap holder strap 50 of FIG. 7 may be suspended horizontally while the caps 34 are suspended in the same orientation described above. In this case, the button 40 is pushed against the then lower edge of the button ring 60, as well as leading or end edge of the button ring 60 (the lower edge as illustrated in FIG. 7). That is, the cap holder strap of FIG. 7 can merely be suspended horizontally instead of vertically. In this case, it may be desirable to provide mechanical fasteners intermediate of the two ends of the cap holder strap to provide additional support. Alternatively, the tongues 54 may be rotated 90 degrees along their longitudinal (that is, the vertical centerline of FIG. 7) by changing the orientation of the die or dies during the manufacturing process so that when the cap holder is suspended horizontally the tongues of the specifically horizontal model have the same orientation as the tongues 54 of FIG. 7. In this case, the cap holder strap 50 must be a little wider than shown in FIG. 7, requiring the use of more material in manufacturing.

Still referring to FIG. 7, it is important to provide a means for connecting or linking more than one cap strap 50 together to permit collectors or vendors to display many caps along one continuous vertical strip. For example, by linking together a 4 ft. (1.3 m) length of the cap straps 50, 13–14 caps 34 can be displayed along a single strip, permitting quick and easy displays with high density. Located in the upper portion 64 of the cap holder strap 50 is a lock 52, having substantially the shape of a conventional coat hanger, which can be used for linking two or more cap holder straps 50 together, or as a mounting aperture for admitting a fastener for attaching the cap holder strap to a wall or the like. The entire area of the lock 52 is cut out from the pattern and discarded. Located in the lower portion of the cap holder strap 50 is a key 70 formed in the lowest tongue 54 adjacent to the crease score 90. The key 70 is fitted into the lock 52, to join two cap holder straps 50 together by pushing the key 70 into the lock 52, as described immediately below.

Figure 10:
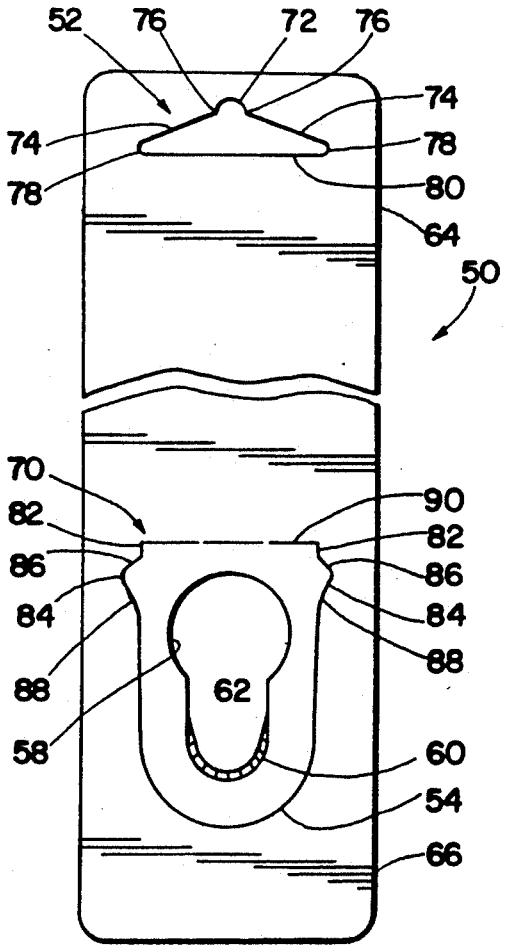
FIG. 10 is an enlarged front elevation of the top portion and bottom portion of the cap holder strap of FIG. 7 showing a lock in the top portion and a matching key in the lower portion for allowing any desired number of cap holder straps to be linked together as in a chain, with the top portion of one cap strap being linked to the bottom portion of another cap strap.

Referring now to FIG. 10, the lock 52 is a die cut aperture of certain configuration. It includes a top central arcuate portion 72, a pair of mirror image downward sloping shoulders 74 connected to the lower ends 76 of the central arcuate portion 72 at one of their respective two ends. The other ends of the sloping shoulders 74 merger into each of two rounded ends 78, which are joined by a straight line cut 80 along the bottom edge of the lock 52.

The key 70 includes a pair of parallel straight line cuts 82 spaced apart substantially the same distance as the two rounded ends 78 of the lock 52 and forming a pair of notches recessed from a pair of ears 84, projecting outwardly from the vertical perimeter of the tongue 54, each connected with a straight line cut 82 by a downward sloping cut 86 (with downward relative to the view shown in FIG. 10). The bulge defined by each ear 84 is then connected to the vertical perimeter of the tongue 54 by downward and inward sloping line that tapers the body of the ears 84 back to the shape of the vertical perimeter of the tongue 54.

Figure 11:
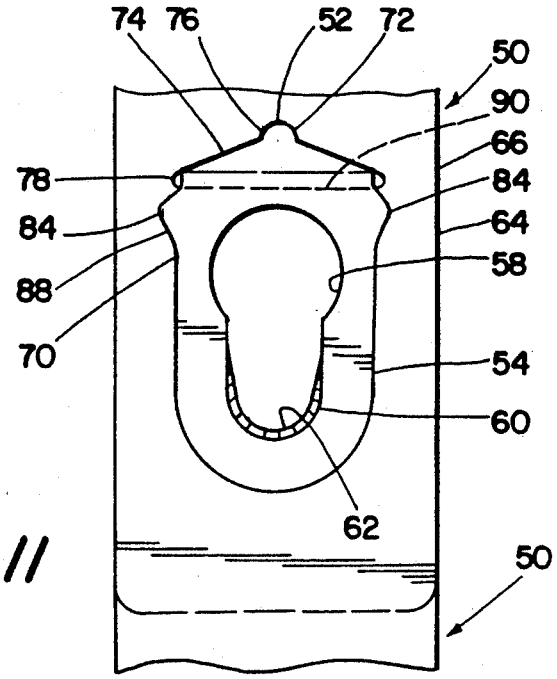
FIG. 11 is a front elevation of two of the cap holder straps of FIG. 7 linked together by the fastening system illustrated in FIGS. 7, 10.

In use, the lowest tongue 54 on a cap holder strap 50 is bent outwardly from the body 52 as shown in FIG. 8 and the lock 52 is pushed over the key 70, which snaps into place with an audible click as the ears 84 are somewhat deformed as they passed through the aperture of the lock 52 and then snap back into their original shape. The lock 52 and the upper portion of the cap holder strap 50 that includes the lock 52 are passed under the lowest tongue 52 (as shown in FIG. 7), allowing unrestricted access to the lowest tongue 52 for mounting a cap 34. The linked lock 52 and key 70 of two cap holder straps 50 are shown in FIG. 11.

Figure 12:
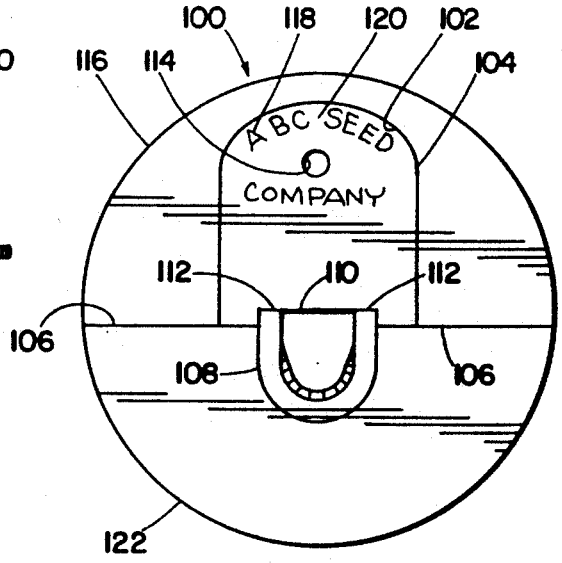
FIG. 12 is a top plan view of an alternative embodiment of a single cap holder similar to the embodiment of FIG. 1, but having a circular shape, when it is flat, that is, after being die cut and prior to mounting.
Figure 13:
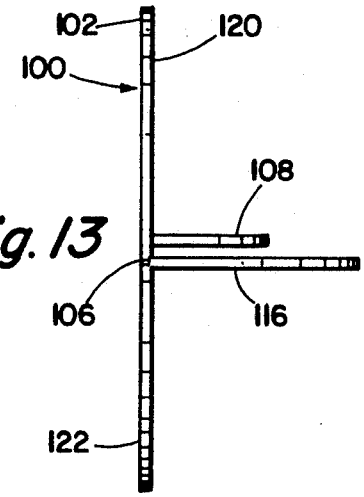
FIG. 13 is a side elevation of the cap holder of FIG. 12 shown bent into the use position.

Referring now to FIGS. 12 and 13, another preferred embodiment of the present invention is illustrated. The circular single cap holder 100 is die cut and scored from a single piece of material, excluding mounting hardware, and is shown in plan view in FIG. 12, as cut. A mounting base 102 is die cut along the line 104 in a U-shape and has a crease score 106 across the diameter of the cap holder 100, except for a button ring 108, which is not scored along the crease score 106. A line 110 appears across the button ring 108 and the area enclosed by the line 110 and the button ring 108 is die cut and removed from the cap holder 100. Crease scores 112 define the edges of the button ring 108. An aperture 114 provides a means for mounting the cap holder 100 on a wall or other vertical surface. Other mounting means, for example, hook and loop fastener sets may also be used as described above.

Still referring to FIGS. 12, 13 to prepare the cap holder 100 for use, a cap supporting member 116, comprising the upper half of the circular cap holder 100 as shown in FIG. 12, except for the mounting base 102 portion, is bent downward as shown in FIG. 12 to about 90 degrees from the mounting base 102, so that in FIG. 12 the cap supporting member would be viewed on edge. Assuming, for example, that the mounting base will be vertical, the cap supporting member 116 will be horizontal. Then the button ring 108 is bent up from the position shown in FIG. 12, so that it too would be viewed on edge in FIG. 12 and is at substantially 90 degrees to the mounting base 102, and is also horizontal when the mounting base 102 is vertical. Thus, the mounting base 102 is typically mounted in a vertical plane, and in use the button ring 108 and the cap supporting member 116 are horizontal and parallel, but spaced apart by the same distance that the crease scores 106, 112 are separated vertically in FIG. 12. A bottom portion 122 of the circular single cap holder 100, which is semicircular in the embodiment shown, but could be another shape, remains in the plane of the pattern when the circular single cap holder 100 is mounted for use, that is parallel to and in the same plan as the mounting base 102. The bottom semicircular portion 122 may, if desired, be attached to a wall by suitable fasteners such as screws, nails, hook and loop fastener sets, and the like, although this is not necessary. The bottom semicircular portion 122 provides a bracing action for the mounting base 102 so that any fastener inserted through the aperture 114 does not bear the entire force applied to the circular single cap holder 100 when in use.

A preferred material for the cap holder 102 is polypropene, which has a memory regarding bends and tends to return to its original unbent position. Therefore, the button ring 108 tends to be pulled downward from its horizontal position by the memory of the plastic and the cap supporting member 116 tends to be pulled up from its horizontal position by the memory of the plastic, as viewed in FIG. 13. These opposing memory forces tend to clamp the cap into the cap holder 100, maintaining it in a good horizontal orientation and overcoming any tendency for the cap to bend the cap holder 100 and cause the cap to sag over time. This effect is enhanced because the memory forces pushing upward on the cap supporting member 116 are far greater than the memory forces pushing downward on the button ring because the amount of plastic involved on the much longer crease score of the cap supporting member 116 is so much greater.

A primary feature of the design of the cap holder 100 is that it provides a clean vertical surface and space above the cap when in use, namely the mounting base 102, which is fully visible when the cap holder 102 is mounted on a wall with a cap on it. This space is ideal for presentation of advertising in the ad specialty market, such as feed companies, farm implement companies, sporting goods companies, and the like, as illustrated by the advertising copy 118 located in an imprint area 120 in FIG. 12.

All embodiments of the invention disclosed herein may be made from any of a variety of suitable materials, such as paper, cardboard, injection molded plastic and the like, but the preferred material is plastic sheet, and the preferred plastic is polypropene and the preferred means of construction is die cutting. The material should be resilient and tough and able to withstand many repeated flexing along score creases, and should not mar or otherwise harm the caps. A memory for a previous position is also desirable, especially for the cap holder 100.

While the present invention has been described in accordance with the preferred embodiments thereof, the description is for illustration only and should not be construed as limiting the scope of the invention. Various changes and modifications may be made by those skilled in the art without departing from the spirit and scope of the invention as defined by the following claims.

I claim:

1. A cap holder comprising:

a. a base adapted for mounting on a vertical surface;

b. a crown supporting member adapted for supporting the crown of a cap attached to said base and perpendicular to said base; and c. a button ring attached by a fastening means to said base and held parallel to and above said supporting member for receiving the button on the top of the cap.

2. A cap holder in accordance with claim 1 wherein said button ring includes a chamfered leading edge.

3. A cap holder in accordance with claim 1 wherein said button ring fastening means further comprises a button ring standoff.

4. A cap holder in accordance with claim 1 further comprising a plurality of apertures in said base for attaching said cap holder to a vertical surface.

5. A cap holder in accordance with claim 1 wherein said crown supporting member further comprises an arcuate front edge portion.

6. A cap holder in accordance with claim 1 wherein said cap holder further comprises polypropene.

7. A cap holder in accordance with claim 1 wherein said base is bent downward at 90 degrees from said crown supporting member.

8. A cap holder in accordance with claim 1 further comprising an advertising imprint area on said base, said advertising imprint area being visible when a cap is mounted on said cap holder.

9. A cap holder in accordance with claim 1 wherein said base is bent upward from said crown supporting member at 90 degrees.

10. A cap holder in accordance with claim 9 wherein said base further comprises an advertising imprint area.

11. A pattern for a cap holder comprising a flat substantially two-dimensional piece of material having an arcuate leading edge, a base, a straight-line first crease score defining a boundary between said base and a crown supporting member whose other boundary comprises said arcuate leading edge, a substantially U-shaped combination of a button ring standoff and a button ring located substantially along said first crease score, with the area defined by the inside edge of said combination button ring standoff and said button ring being cut out from the pattern and removed, and a pair of aligned second crease scores forming a boundary between said button ring and said button ring standoff.

12. A pattern in accordance with claim 11 further comprising means for mounting the cap holder formed from said pattern to a vertical surface.

13. A pattern in accordance with claim 11 further comprising a plurality of mounting apertures in said base.

14. A pattern for a cap holder comprising a flat substantially two-dimensional piece of material having an outer perimeter divided into a mounting base including an advertising imprint area and a crown supporting area by a crease score, and a substantially U-shaped button ring formed substantially in the center of said pattern and attached to said base with the interior portion of said U-shaped button ring being cut from said pattern and discarded, and a pair of aligned crease scores defining the boundary between said base and said button ring.

15. A pattern in accordance with claim 15 wherein said button ring further comprises a chamfer.

16. A pattern in accordance with claim 16 wherein said chamfer is feathered at each point where said button ring abuts said base.

17. A cap holder strap comprising:

a. an elongated strip of material having a top and a bottom and a longitudinal axis;

b. a plurality of U-shaped tongues formed in said material by cutting through said material, with said U-shaped tongues spaced along said longitudinal axis, each said U-shaped tongue having a button ring cut through it, wherein each said button ring is adapted to hold one cap by the button at the top of the cap.

18. A cap strap holder comprising:

a. an elongated strip of material having a top and a bottom and a longitudinal axis;

a plurality of tongues formed in said material along said longitudinal axis, with each said U-shaped tongue adapted to hold one cpa by the button at the top of the cap, wherein each said tongue further comprises a substantially U-shaped tongue formed by cutting through said material around the legs and bottom of the U; and c. a substantially U-shaped button ring cut into said tongue and a button access aperture cut into said ring with said button access aperture adjacent to and communicating with said button ring, with the area inside said button access aperture and said button ring being cut and discarded.

19. A cap strap holder in accordance with claim 18 wherein said button ring further comprises a chamfer along said U-shape.

20. A cap strap holder in accordance with claim 18 wherein said linking means further comprises:

a. a lock at the top of said strip comprising an aperture having substantially the shape of a coat-hanger; and b. a key formed into the lowest said tongue on one said cap holder strap adjacent to the top of said lowest tongue, said key further comprising a pair of projecting ears spaced downward from said top of said tongue.

21. A cap strap holder in accordance with claim 20 wherein each said ear merges with the straight lines defining the width of said tongue by means of an angled line cut.

22. A cap strap holder in accordance with claim 21 wherein said lock further comprises an arcuate top having two symmetric downward sloping shoulders terminating at their lower ends in a pair of opposed rounded ends and a straight horizontal line connecting said lower ends.

23. A cap strap holder in accordance with claim 18 further comprising polypropene.

24. A cap strap holder in accordance with claim 18 further comprising a crease score along across the top of each said tongue.

25. A cap holder strap comprising:

a. an elongated strip of material having a top and a bottom and a longitudinal axis;

b. a plurality of tongues formed in said material along said longitudinal axis, each said tongue adapted to hold one cap by the button at the top of the cap, each said tongue further comprising a substantially U-shaped tongue formed by cutting through said material around the legs and bottom of the U, a substantially U-shaped button ring cut into said tongue and a button access aperture cut into said ring with said button access aperture adjacent to and communicating with said button ring, with the area inside said button access aperture and said button ring being cut out and discarded; and c. means for linking the top of one said cap holder strap to the bottom of another cap holder strap.

26. A cap holder strap comprising:

a. an elongated strip of material having a top and a bottom and a longitudinal axis;

b. a plurality of tongues formed in said material along said longitudinal axis, each said tongue adapted to hold one cap by the button at the top of the cap, each said tongue further comprising a substantially U-shaped tongue formed by cutting through said material around the legs and bottom of the U, a substantially U-shaped button ring cut into said tongue and a button access aperture cut into said ring with said button access aperture adjacent to and communicating with said button ring, with the area inside said button access aperture and said button ring being cut out and discarded; and c. means for linking the top of one said cap holder strap to the bottom of another cap holder strap, said linking means further comprising a lock at the top of said strip comprising an aperture having substantially the shape of a coat-hanger, and a mating key formed into the lowest said tongue on one said cap holder strap adjacent to the top of said lowest tongue, said key further comprising a pair of projecting ears spaced downward from said top of said tongue.

27. A cap strap holding in accordance with claim 17 further comprising means for linking the top of one cap strap to the bottom of another cap strap.

28. A cap strap holding in accordance with claim 18 further comprising means for linking the top of one cap strap to the bottom of another cap strap.

* * * * *